US006260238B1

(12) United States Patent
MacMillan

(10) Patent No.: US 6,260,238 B1
(45) Date of Patent: Jul. 17, 2001

(54) ADJUSTABLE LENGTH HANDLE FOR FLAT FINISHERS

(76) Inventor: Donald Mark MacMillan, 151 - 10090 - 152nd St., Box 223, Surrey, BC. (CA), V3R 8X8

( * ) Notice: Subject to any disclaimer, the term of this patent is extended or adjusted under 35 U.S.C. 154(b) by 0 days.

(21) Appl. No.: 09/414,677

(22) Filed: Oct. 7, 1999

(51) Int. Cl.[7] ..... B05C 17/10; B25G 1/04

(52) U.S. Cl. ..... 16/429; 15/144.1; 15/144.2; 15/144.3; 15/144.4

(58) Field of Search ..... 16/429; 15/144.1, 15/144.2, 144.3, 144.4, 235.8

(56) References Cited

U.S. PATENT DOCUMENTS 1,021,557 * 3/1912 Runner ..... 15/145
5,088,147 * 2/1992 MacMillan ..... 15/144.4

* cited by examiner

*Primary Examiner*—Robert J. Sandy
*Assistant Examiner*—Matthew E. Rodgers
(74) *Attorney, Agent, or Firm*—Robert W. Jenny

(57) ABSTRACT

The primary structural parts of the handle are two extruded telescopic tubes. A longitudinal rib on the smaller, inner tube slides in a groove in the rib on the larger, outer tube, preventing relative motion between the tubes. A box footplate is pivotally attached on a shaft to the free end of the outer tube with the axis of the shaft intersecting the long axis of the tubes and perpendicular to it. Rotation of the footplate is transferred by bevel gearing to a rod at the centers of the tubes which extends through a collet mechanism installed inside the smaller tube near its overlapped end. A lever and related linkage are attached to a fitting installed at the free end of the inner tube. The linkage connects the lever to the collect mechanism. Operation of the lever causes the collet to clamp onto the rod, thus locking the box footplate angular motion and the length of the handle. An auxiliary mechanism may be provided for locking the handle at any of a series of lengths.

4 Claims, 1 Drawing Sheet

A
3
3
2
2

ADJUSTABLE LENGTH HANDLE FOR FLAT FINISHERS

BACKGROUND OF THE INVENTION

1. Field

The subject invention is in the field of extendable/retractable apparatus such as tent poles, fishing rods and boat hooks which can be set at any length within a length range. More specifically it is in the field of such apparatus which incorporates mechanism by which one mechanism at one end of the apparatus operates and controls another mechanism at the other end of the apparatus. Still more specifically it is in the field of such apparatus and related mechanisms adapted for use with apparatus used in construction of dry walls in buildings, apparatus known in the trade as a flat finishing box, used in the crowning and finishing of taped joints between drywall panels.

2. Prior Art

Known prior art is shown in the patents listed below. These patents are:

| | |
|---|---|
| 2,934,937 | 4,592,797 |
| 3,105,262 | 5,088,147 |
| 3,146,481 | 5,099,539 |
| 3,090,984 | |

In the field of drywall construction and finishing, apparatus termed a flat finishing box is attached to a handle to enable the operator to apply the box to the joints being serviced by the box. To adapt the apparatus to various use situations various lengths of handles are needed to work with, for example, a variety of heights of ceilings and, also, the box must be set in a range of angles with respect to the long axis of the handle. The conventional apparatus comprises a fixed length handle with a lever at one end operable to lock the box pivoted at the other end of the handle at a specific angle to the handle axis. When a variety of lengths of handles is required, it is necessary either to have a number of flat finishing boxes, each attached to a specific length handle or to use fewer boxes than handle lengths required, (usually one box) and interchange the box or boxes from handle to handle in order to have the box on a handle of suitable length. The use of multiple boxes, each with a different length handle attached, is not generally acceptable because of the cost and because the compound used in the boxes sets up, i.e. hardens, so that compound in boxes not fully emptied in use is wasted and removal of the wasted compound is time consuming. The use of fewer boxes than handles is standard practice but changing the boxes from handle to handle is time consuming and tends to be awkward if the box contains the compound referred to in the trade as "mud".

Therefore, for flat finishing drywall joints more efficiently in terms of the interrelated factors of time and cost, there has been a need for a flat finishing tool with an adjustable length handle, particularly one adjustable to specific lengths in a range of lengths.

U.S. Pat. Nos. 5,099,539 (Forrester) and 5,088,147 (MacMillan, the inventor of the subject invention) both show adjustable length handles for flat finishers. Both of these handles have a lever pivoted at one end and a part called a box footplate pivoted at the other. In use a flat finishing box is attached to the footplate, the handle is adjusted to the needed length, and the handle is maneuvered to place the box against the work surface. This placement sets the box and footplate at an angle to the long axis of the handle and the lever is operated to lock the box and footplate at that angle relative to the handle. The mechanical complexity of these prior art adjustable length handles for flat finishers is typical in the prior art increases first and maintenance costs of the handles and degrades their reliability, thereby increasing operation costs. The lock mechanism in particular tends to be delicate relative to its performance requirements and the range of angular motion of the box footplate is quite limited.

Accordingly, the primary objective of the subject invention is to provide a less complicated adjustable length handle for flat finishes because of the significant savings in costs that the reduced complication facilitates. Other objectives are that the range of angular motion of the box footplate be relatively large, that there be no highly loaded small parts, that the handle be relatively lightweight and that it be ergonomically acceptable.

SUMMARY OF THE INVENTION

The subject invention is an adjustable length handle for flat finishers. The primary structural components of the handle are two telescopic extruded tubes. Relative rotation of the engaged tubes is prevented by engagement of a longitudinal rib on the outside of one tube with a groove on the inside of the other tube. When the tubes are telescopically engaged each has an overlapped end and a free end. A fitting termed a box footplate is pivotally attached to the free end of the larger, outer tube, with the pivot axis perpendicular to the long axis of the tubes. The pivot is a shaft running in bearings in a second fitting which is attached to the free end of the outer tube. A bevel gear on this pivot shaft engages a second bevel gear which is mounted in a shaft which extends along the axis of the tubes and through a collet assembly mounted in the overlapped end of the inner tube. The collet assembly comprises the collet and a collet receiver. The collet is attached to a tube which extends through a fitting at the free end of the inner tube. The tube is linked to a lever attached to the fitting such that when the lever is operated it pulls on the tube and collet and causes the collet to grip the rod and thereby prevent it and the box footplate from rotating and pivoting respectively. The gripping of the rod by the collet also prevents telescopic relative motion between the tubes, thereby preventing change in the overall length of the handle while the lever is being operated.

A second embodiment of the invention includes mechanism for adjusting handle length independently of the collet action. This mechanism is attached to the overlapped end of the outer tube and includes a button operated slide which disengageably engages one of a plurality of notches in the longitudinal rib on the inner tube. Pushing the button causes disengagement and allows telescopic action for length adjustment. When the button is released the slide engages the first notch it encounters, locking the length of the handle.

In use the handle is adjusted to a needed length and either locked at that length by the locking mechanism or held at that length while a finishing box attached to the box footplate is placed against a work surface, setting the box footplate at a particular angle to the axis of the handle. The lever is then operated, locking the box footplate at that angle and locking the handle at the set length if it is not already locked by the locking mechanism.

The invention is described in more detail below with reference to the attached drawings.

DETAILED DESCRIPTION OF THE INVENTION

Figure 1:
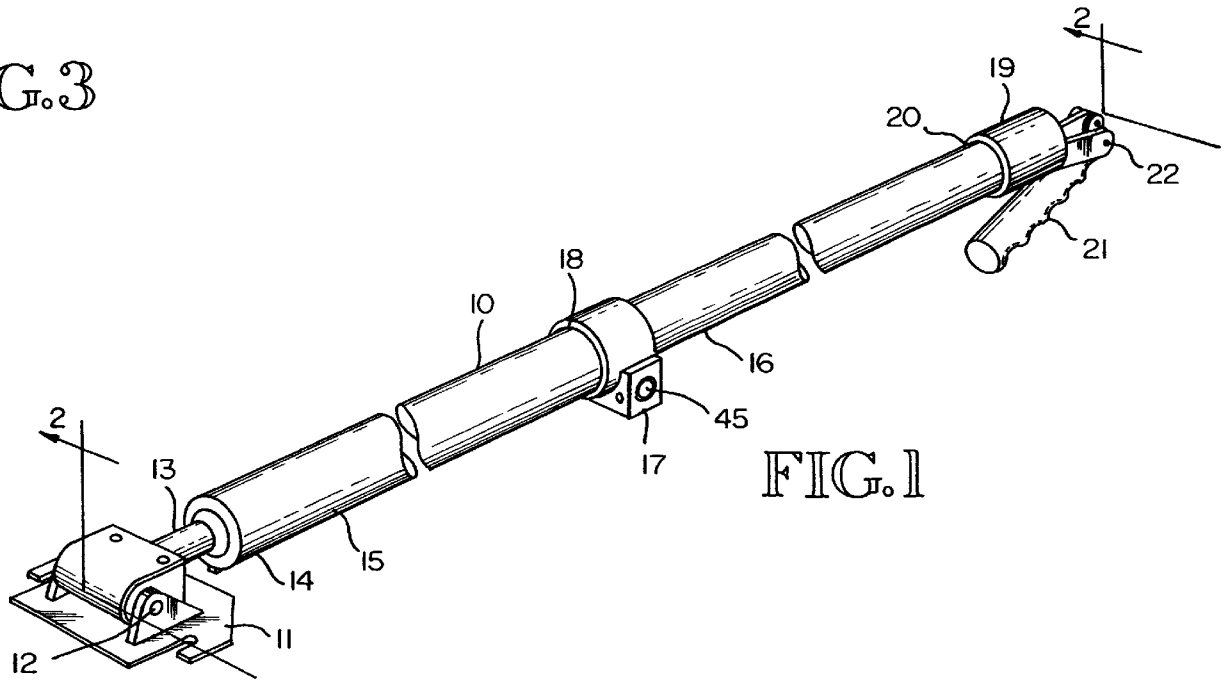
FIG. 1 is a general view of the subject handle, foreshortened.

The subject invention is an adjustable length handle for flat finishers. FIG. 1 is a general view of the subject handle 10. In use a flat finishing box is attached to box footplate 11 which is pivotally attached on shaft 12 to fitting 13. Fitting 13 is attached to free end 14 of tube 15 which slides telescopically on tube 16. Cover 13' protects the gears. Lock mechanism 17, attached to overlap end 18 of tube 15, is an alternate mechanism for locking the handle at any of a plurality of lengths. Fitting 19, attached to free end 20 of tube 16, supports lever 21 pivoted at 22 to fitting 19. Lever 21 is linked to mechanism described below which, when the lever is moved toward tube 16, prevents angular movement of the box footplate 11 relative to the tubes.

Figure 2:
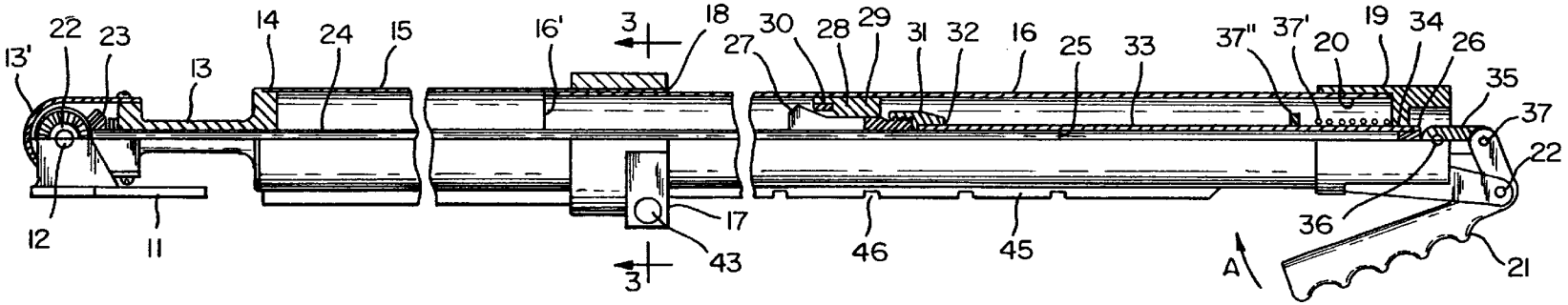
FIG. 2 is a partially sectioned semi-schematic drawing of the handle of FIG. 1 with the section taken at 2—2 in FIG. 1.

FIG. 2 is a partially sectioned semi-schematic drawing of the handle with the section taken at 2—2 in FIG. 1 with a parts numbered as in FIG. 1. Bevel gear 22 and box footplate 11 are fastened onto shaft 12. Bevel gear 23 engages gear 22 and is fastened to rod 24 which is journalled in fitting 13 and has a length such that when the handle is at its shortest length end 25 of the rod is close to fitting 26. This arrangement interlocks rotations of rod 20 and axle 12. If the rotation of rod 24 is prevented, the angular position of the box footplate relative to the tubes is fixed. The rotation of rod 24 can be prevented by moving lever 21 in the direction of arrow A. The motion and force applied to lever 21 are transmitted to collet 27 installed in collet receiver assembly 28 attached inside tube 16 near end 16'. The force pulls the collet into the receiver assembly, clamping it onto the rods. The collet receiver assembly comprises body 29 and hardened insert 30. The force and motion are transmitted to the collet via (1) fitting 31 attached to end 32 of tube 33, (2) tube 33, (3) fitting 26 attached to end 34 of tube 33, and (4) link 35 which is pinned to fitting 26 at pin 36 and to lever 21 at pin 37. The clamping of the collet onto rod 24 also locks the handle at its set length. Spring 37', acting against stop 37", provides return force for the linkage.

Figure 3:
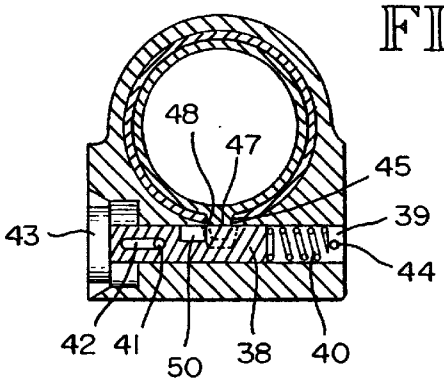
FIG. 3 is a section taken at 3—3 in FIG. 2, showing a length lock mechanism.

In the embodiment of the invention shown in the drawings the handle length can also be locked by the locking mechanism 17. FIG. 3 is a section taken at 3—3 in FIG. 2 showing details of the length lock mechanism. Lock bar 38 is square or rectangular so that it slides but does not rotate in hole 39. The bar is retained in the hole against the force of spring 40 by pin 41 in slot 47. Head 43 is pressed to unlock the lock. Pin 44 retains the spring. The mechanism is shown in the lock condition. The bar is engaged in a notch in rib 45 on tube 16, notch 46 in FIG. 2 being typical. The tubes are extrusions and rib 47 on tube 16 slides in groove 48 inside rib 49 (see FIG. 2) on tube 15. The engagement of rib 47 in groove 48 prevents relative rotation between the tubes. When head 43 is pressed, cut-out 50 in bar 38 is moved such that the bar is disengaged from the notch and rib 47 and tube 16 can move relative to groove 48, rib 49 and tube 15. Once unlocking is done and head 43 is released, the mechanism remains unlocked until telescopic relative motion of the tubes lines up the bar with a notch and spring 40 moves the bar into the position shown on the drawing.

It is considered to be understandable from this description that the subject invention meets its objectives. It provides a less complicated adjustable length handle for flat finishers. One lock locks both the length of the handle and the angle of the box footplate and flat finishing box relative to the longitudinal axis of the handle. The parts involved in the locking are relatively large for the loads they carry in comparison to the small highly loaded locking parts in prior art handles. The locking mechanism allows a wide range of angular motion of the box footplate. Also the handle is relatively light in weight and is designed to be ergonomically acceptable.

It is also considered to be understood that while certain embodiments of the invention are described herein, other embodiments and modifications of those described are possible within the scope of the invention which is limited only by the attached claims.

I claim:

1. An adjustable length handle for flat finishers, said handle comprising:

a box footplate, first and second telescopic tubes telescoped together, a lever and a collet mechanism, said collet mechanism being installed in said second tube, said lever being pivotally attached to said second tube, said box footplate being attached to said first tube by a pivot connection, said handle further comprising:

first and second bevel gears, means for actuating said collet mechanism by operation of said lever, and means, including said first and second bevel gears, for interconnecting said box footplate and said collet mechanism such that actuation of said collet mechanism prevents rotation of said box footplate on said pivot connection.

2. The handle of claim 1 further comprising a lock mechanism locking said handle at any of a plurality of lengths.

3. An adjustable length handle for flat finishers, said handle comprising:

a first tube and a second tube, said first tube having a first tube axis, said second tube having a second tube axis, said second tube fitting telescopically into said first tube, each of said tubes having, when said second tube is inserted into said first tube, a free end and an overlap end, said handle further comprising:

a box footplate, a shaft having a shaft axis, a rod having a rod centerline, a first bevel gear and a second bevel gear.

a collet mechanism, a lever, linkage connecting said lever to said collet mechanism, said box footplate being attached onto said shaft, said shaft being pivotally mounted on said free end of said first tube with said shaft axis normal to said first and second tube axes, said collet mechanism being installed inside said second tube near said overlap end of said second tube, said rod being installed in said tubes, extending through said collet mechanism with said rod axis coincident with said first and second tube axes, said first bevel gear being installed on said shaft and said second bevel gear being installed on said rod such that said shaft and said rod are rotationally interlocked and such that prevention of rotation of said rod by activation of said collet mechanism through said linkage by operation of said lever prevents angular motion of said box footplate relative to said tubes.

4. The handle of claim 3 further comprising a lock mechanism locking said handle at any of a plurality of lengths.

* * * * *